US005875765A

United States Patent [19]

Norton

[11] Patent Number: 5,875,765

[45] Date of Patent: Mar. 2, 1999

[54] FUEL VAPOR SOURCE

[76] Inventor: Peter Norton, P. O. Box 62, Northville, Mich. 48167

[21] Appl. No.: 674,175

[22] Filed: Jul. 1, 1996

[51] Int. Cl.[6] ..... F02M 37/04

[52] U.S. Cl. ..... 123/520; 73/861.02; 123/516

[58] Field of Search ..... 123/520, 521, 123/518, 519, 516, 198 D; 73/861.02

[56] References Cited

U.S. PATENT DOCUMENTS

| | | | |
|---|---|---|---|
| 4,193,291 | 3/1980 | Lynnworth | 73/32 |
| 5,152,174 | 10/1992 | LaBudde | 73/861.02 |
| 5,359,980 | 11/1994 | Tomisawa | 123/520 |
| 5,373,822 | 12/1994 | Thompson | 123/520 |
| 5,386,812 | 2/1995 | Curran et al. | 123/520 |
| 5,390,644 | 2/1995 | Nonogaki | 123/520 |
| 5,445,133 | 8/1995 | Nemoto | 123/520 |
| 5,469,832 | 11/1995 | Nemoto | 123/520 |
| 5,559,706 | 9/1996 | Fujita | 123/520 |
| 5,596,972 | 1/1997 | Sulltan et al. | 123/520 |
| 5,606,955 | 3/1997 | Yuda | 123/520 |

*Primary Examiner*—Carl S. Miller
*Attorney, Agent, or Firm*—Paul J. Ethington

[57] ABSTRACT

A canister contains two cartridges of activated carbon for storing fuel in gasoline powered motor vehicles. A first cartridge operates to adsorb gasoline vapor produced in the fuel tank while the vehicle is not operating. The second cartridge operates to adsorb gasoline vapor from the fuel tank. Vacuum from the intake manifold or a vacuum pump draws fuel saturated air from the fuel tank and through the second cartridge thereby charging it with adsorbed fuel. Charging is terminated when fuel passes through the second cartridge without being adsorbed. Much or most of the fuel adsorbed is the lightest and most volatile fraction of the gasoline which is usually butane. Fuel vapor from both cartridges is combined with air to fuel the vehicle on initial startup thereby providing vaporized fuel to the vehicle engine and purging both cartridges of fuel. An air-fuel ratio sensor and a fuel vapor sensor are jointly achieved by comparing the transit time of sound in two chambers, one containing air and the other containing a mixture of air and fuel. The air-fuel ratio sensor measures the ratio of air to fuel provided to the engine during initial startup. The fuel vapor sensor senses the onset of vapor passage during charging of the second cartridge. The ratio of air to fuel provided to the engine during initial startup may also be ascertained by providing a mass flow sensor in the outlet of the fuel vapor source. During initial startup a valve controls flow of vapor from the canister to maintain a desired air-fuel ratio.

24 Claims, 4 Drawing Sheets

FUEL VAPOR SOURCE

FIELD OF THE INVENTION

This invention relates to means for providing gaseous fuel for enhancing performance and reducing unwanted emissions during startup of gasoline powered engines. It also relates to means for preventing emission of fuel vapor to the atmosphere while a vehicle is not operating.

BACKGROUND OF THE INVENTION

Gasoline engines emit undesirable amounts of hydrocarbon vapors when first started. This happens because liquid gasoline can become trapped in crevices in a cold engine and not be vaporized in time to participate in combustion and because the catalytic converter does not oxidize hydrocarbon vapors until it reaches a "light-off" temperature. This problem is exacerbated by the need to provide a fuel rich mixture when the engine is first started. One known way to reduce hydrocarbon emissions is to electrically heat part of the catalytic converter before starting the engine. This has the disadvantages of delaying starting and requiring large amounts of electrical energy at times when the battery is least able to supply such energy. Another known way to reduce hydrocarbon emissions at startup is to pass the exhaust through an adsorbent for storing hydrocarbon emissions. When the catalytic converter reaches operating temperature the adsorbent is flushed and the catalytic converter oxidizes the flushed hydrocarbons.

It is well known that a cold automobile engine fueled with methane exhausts less hydrocarbons than if fueled with gasoline. It is also well known that cold gasoline engines run more smoothly and efficiently if operated on methane instead of gasoline. Butanes and pentanes are less volatile than methane but offer similar advantages and are components of gasoline.

Canisters of activated carbon have been used for many years to adsorb fuel vapors produced while vehicles are not operating. The canisters are purged while the vehicle is operating thereby preparing them to adsorb fuel vapor again. A number of types of activated carbon are in current use or available made from raw materials such as wood and coal.

It is also well known that during purging activated carbon releases the most volatile fuel vapors first before releasing less volatile fuel vapors. Activated carbon charged with vapors from gasoline first releases predominantly butanes, then releases predominantly pentanes.

Oxygen sensors in the exhaust of gasoline engines have been standard equipment for many years. After a brief warmup period they indicate the presence of oxygen in the engine exhaust whereupon the information provided is used to optimize the delivery of fuel to the engine.

Current automobile engines include means for measuring or computing the amount of air entering the engine. This is most often accomplished by combining the rate of rotation of the engine, the displacement of the engine, the absolute pressure in the intake manifold and other factors according to an algorithm that provides the rate of flow of air into the engine. This is also accomplished by providing a hot wire anemometer or other mass flow sensor to directly measure the flow of air into the engine.

The velocity of sound in air is about 330 meters per second and the velocity of sound in butanes is about 215 meters per second. In a mixture the velocity varies between these values. In a stoichiometric mixture of air and butane the velocity of sound is about 15 meters per second slower than in pure air.

A general object of this invention is to provide a means for reducing hydrocarbon emissions and improving operation of gasoline powered engines during initial startup which also overcomes certain disadvantages of the prior art.

SUMMARY OF THE INVENTION

The present invention provides a canister containing two separated cartridges of activated carbon. The first cartridge adsorbs fuel vapors to prevent their escape when the vehicle is not operating. The second cartridge is kept fully charged with fuel. The fuel vapor adsorbed by both cartridges is used to fuel the engine during startup. This is advantageous because the fuel vapor bums more completely than liquid fuel thereby reducing hydrocarbon emissions and improving engine operation.

Further, in accordance with the invention, the second cartridge stores sufficient fuel that only the first species deadsorbed (predominantly butanes) issues before the oxygen sensor is operational. Thereby, before the oxygen sensor becomes operational, the velocity of sound in the air-fuel mixture is a known function of the air to fuel ratio which advantageously enables measurement of the air to fuel ratio by measuring the velocity of sound in the mixture.

Further, in accordance with the invention, an acoustic transducer generates an outgoing acoustic signal and also receives an echo of that signal which is advantageous because the effects of movement of the medium in which the signal moves are substantially cancelled during the opposite directions of sound travel.

Further, in accordance with the invention, an acoustic transducer generates a radial outgoing acoustic signal and a cylindrical reflector concentric with the outgoing acoustic signal reflects the signal back toward the transducer thereby advantageously concentrating the reflected sound on the transducer and increasing the received acoustic signal.

Further, in accordance with the invention, an air-fuel ratio sensor comprises means for measuring the velocity of sound in the mixture of air and fuel.

Further, in accordance with the invention, an air-fuel ratio sensor comprises means for comparing the transit time of sound in the mixture of air and fuel with the transit time of sound in air not mixed with fuel.

Further, in accordance with the invention, a desired air-fuel ratio is maintained by controlling a valve in response to an air-fuel ratio sensor.

Further, in accordance with the invention, a fuel vapor sensor indicates when the aforementioned second cartridge is fully charged whereupon a normally closed solenoid valve is allowed to close to prevent further charging.

Further, in accordance with the invention, a fuel vapor sensor comprises means for measuring the velocity of sound in air which might contain fuel.

Further, in accordance with the invention, a fuel vapor sensor comprises means for comparing the transit time of sound in air which might contain fuel with the transit time of sound in air not mixed with fuel.

Further, in accordance with the invention, a vacuum actuated valve is opened by manifold vacuum to admit air for purging both cartridges.

Further, in accordance with the invention, the flow of air and fuel vapor provided by the fuel vapor source may be measured by a mass flow sensor such as a hot wire anemometer. The mass flow rate of fuel vapor measured by the hot wire anemometer is combined with the mass flow of air into the engine intake manifold to compute the air-fuel ratio.

Further, in accordance with the invention, charging of the aforementioned second cartridge is accomplished by using manifold vacuum to draw vapor from the fuel tank through the aforementioned second cartridge.

Further, in accordance with the invention, charging of the aforementioned second cartridge is accomplished by using an electric pump to draw vapor from the fuel tank through the aforementioned second cartridge.

Further, in accordance with the invention, a check valve releases pressure developed while the vehicle is not operating but prevents reverse flow when the aforementioned second cartridge is being charged.

Further, in accordance with the invention, fuel vapor from the canister may be augmented at certain times by liquid fuel.

A complete understanding of this invention may be obtained from the description that follows taken with the accompanying drawings.

BEST MODE FOR CARRYING OUT THE INVENTION

Figure 1:
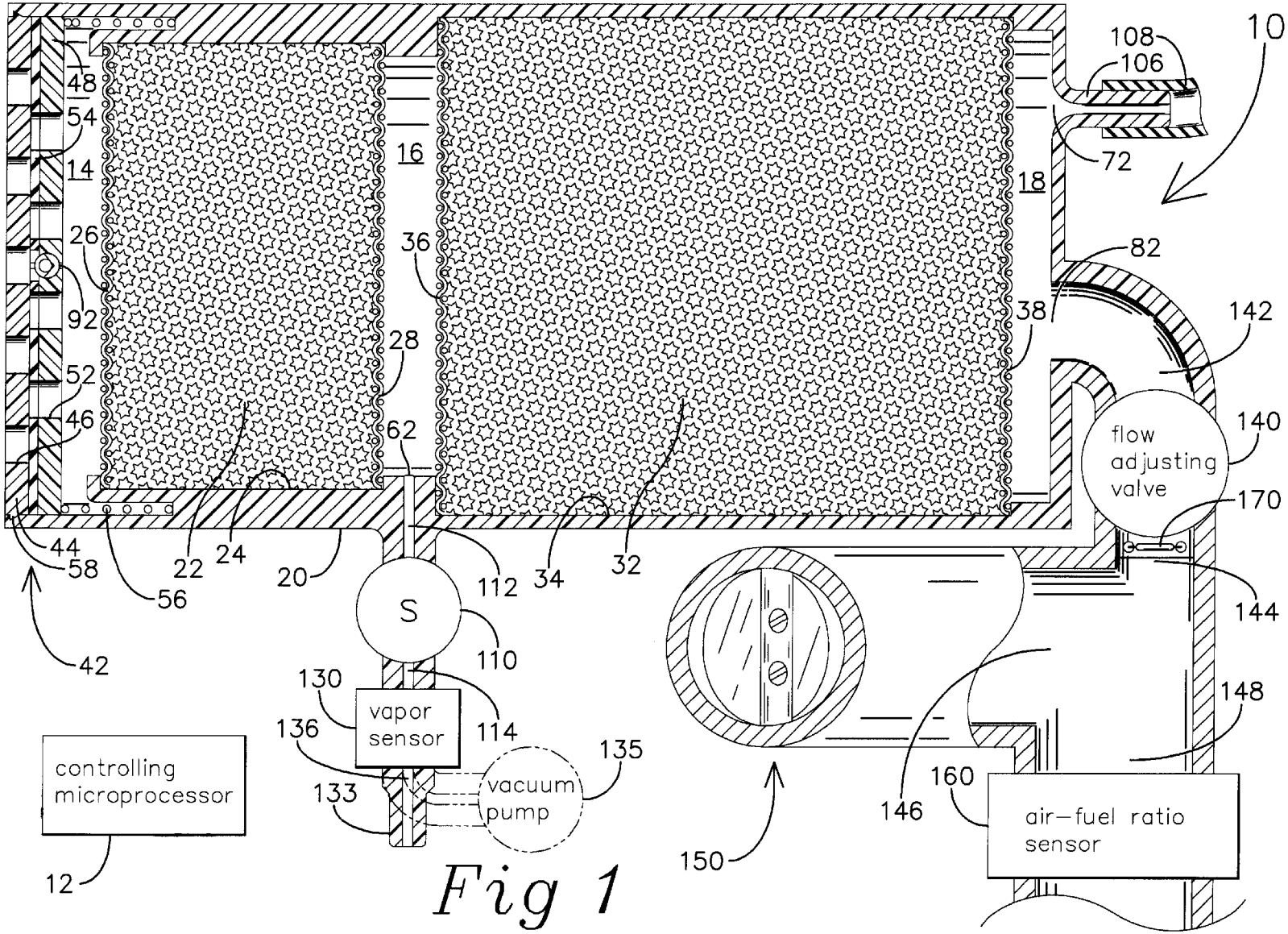
FIG. 1 shows a side view of the canister of the invention with certain parts shown in section.

Referring now to FIG. 1, the fuel vapor source 10 contains activated carbon cartridges 22 and 32. During operation of the fuel vapor source 10 the cartridges 22 and 32 of the fuel vapor source 10 adsorb and release fuel vapors. It will be appreciated as the description proceeds that the invention may be implemented in different embodiments.

Controlling microprocessor 12 controls operation of the fuel vapor source 10. Preferably, controlling microprocessor 12 is the microprocessor that controls other aspects of the operation of the engine. Controlling microprocessor 12 is connected to the fuel vapor sensor 130 for receiving indication of fuel vapor entering through passage 112 and to air-fuel ratio sensor 160 for receiving indication of the ratio of air to fuel entering sensor 160 through passage 148. Controlling microprocessor 12 is also connected to solenoid valve 110 for energizing it to open and to flow adjusting valve 140 for energizing it to change its state to be more open or less open. If electric vacuum pump 135 is included controlling microprocessor 12 is also connected to electric vacuum pump 135 for energizing it at certain times.

Figure 2:
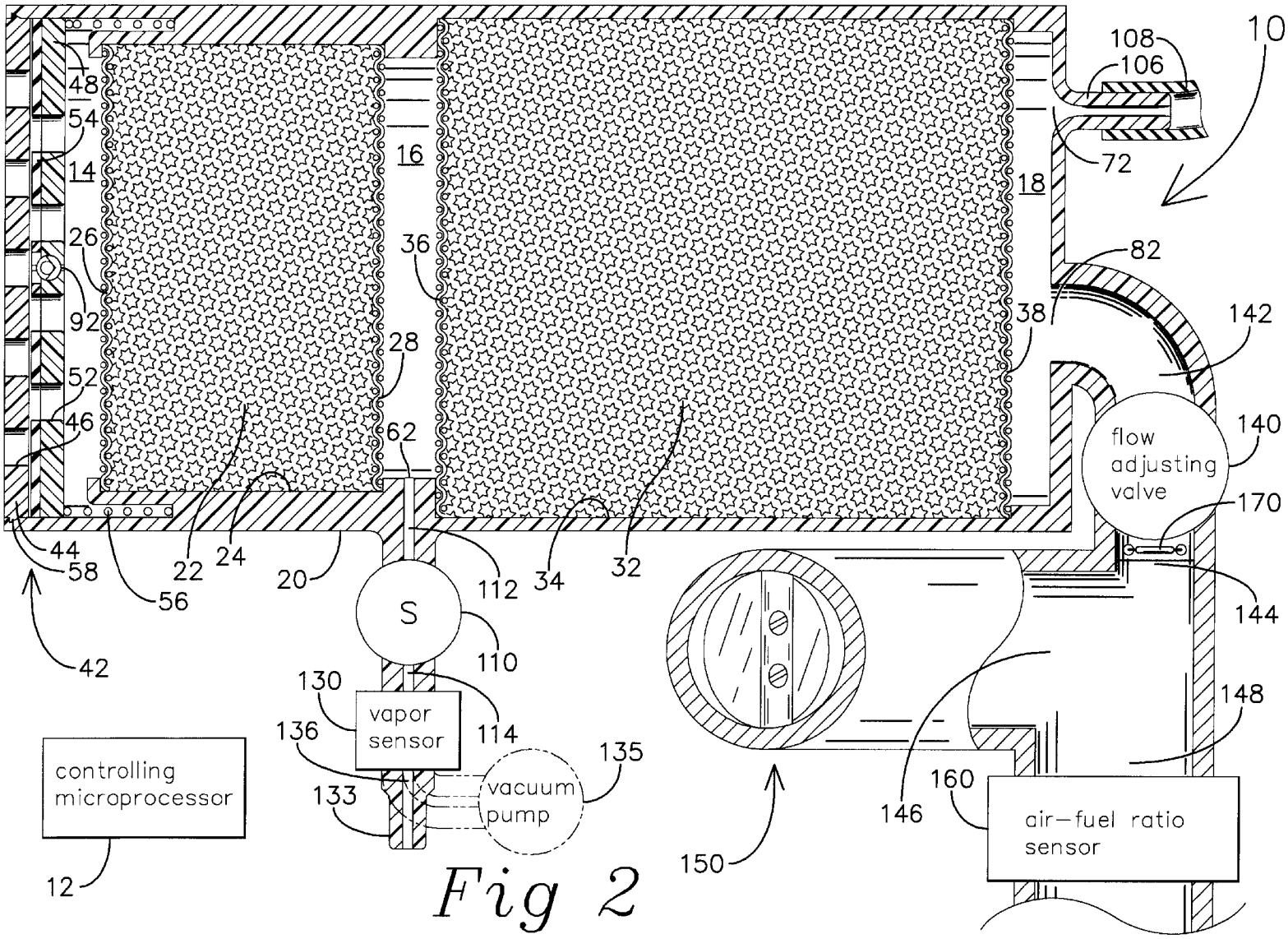
FIG. 2 shows the side view of the canister of the invention illustrated in FIG. 1 with the vacuum operated valve open.

Referring particularly to FIGS. 1 and 2, outer housing 20 contains activated carbon cartridges 22 and 32. Vacuum actuated valve 42 is located at one end of outer housing 20. Openings 62, 72 and 82 communicate respectively with the intake manifold vacuum and optional electric vacuum pump 135, the fuel tank, and chamber 146 of the intake manifold. Opening 62 communicates with the manifold vacuum through normally closed solenoid valve 110, fuel vapor sensor 130, nipple 133 and a conduit such as elastomeric tubing that is not illustrated. Opening 62 may also communicate with optional vacuum pump 135, which is illustrated with phantom lines to indicate it is optional, through normally closed solenoid valve 110 and fuel vapor sensor 130. Opening 72 communicates with the vehicle fuel tank (not illustrated) through nipple 106 and elastomeric tubing 108. Opening 82 communicates with chamber 146 of the engine intake manifold through conduit 142, flow adjusting valve 140, and conduit 144. Throttle 150 is controlled by the vehicle operator to supply air to chamber 146 of the vehicle intake manifold.

FIG. 2 is the same as FIG. 1 except that it illustrates vacuum actuated valve 42 in its open state wherein it allows outside air to enter chamber 14.

Outer housing 20 is preferably molded from a suitable moldable plastic. Phenolic and glass filled polyester are suitable. Any plastic known to be suitable by those skilled in the art of fuel vapor canister manufacture may be used.

Cartridge 22 is an aggregate of activated carbon granules retained by the inside diameter 24 of outer container 20 and screens 26 and 28. Similarly, cartridge 32 is an aggregate of activated carbon granules retained by the inside diameter 34 of outer container 20 and screens 36 and 38. Screens 26, 28, 36 and 38 retain the activated carbon granules but allow air and fuel vapor to pass.

Cartridges 22 and 32 are preferably made of any of the activated carbon granules used in current production vehicles. Other available forms of activated carbon may be substituted by those skilled in the art to achieve possibly desired results such as greater flow or greater vapor capacity.

Vacuum actuated valve 42 comprises valve seat 44 with openings 46, movable valve plate 48 with openings 52, resilient seal 54 and spring 56. Valve seat 44 is held in place by annular latch 58. Check valve 92 is located at the center of movable valve plate 48.

Valve seat 44 and movable valve plate 48 are preferably made of the same moldable plastic as outer housing 20. Resilient seal 54 is made of any of the known elastomeric sealing materials such as silicone rubber or neoprene rubber in formulations known by those skilled in the art to maintain their resiliency for the expected lifetime of the automobile in the atmosphere encountered in the part of the automobile where the fuel vapor source 10 is to be located. Spring 56 maintains vacuum actuated valve 42 in a normally closed state and is designed to apply force adequate to maintain vacuum actuated valve 42 in its normally closed state during all times of normal operation except when flow adjusting valve 140 is open.

Solenoid valve 110 is an electrically actuated valve that is opened to enable the vacuum normally present in the engine intake manifold or vacuum provided by electric vacuum pump 135 to draw vapor from the vehicle fuel tank through tubing 108, nipple 106 of outer housing 20, cartridge 32, passage 112, solenoid valve 110, passage 114 and fuel vapor sensor 130. If present electric vacuum pump 135 will fully charge cartridge 32 in case the engine is turned off before cartridge 32 is fully charged. Solenoid valve 110 remains closed when it is not supplied with electric power and opens when supplied with electric power. Solenoid valve 110 may be made according to any solenoid valve design known to be suitable by those skilled in the art of solenoid valve design. If electric vacuum pump 135 is included it may be of any design capable of drawing air mixed with fuel vapor from the vehicle fuel tank and through cartridge 32 at a rate of about 0.1 to 1.0 liters per minute.

Fuel vapor sensor 130 is adapted to sense fuel vapor received through passage 114 from solenoid valve 110 at times when normally closed solenoid valve 110 is open. A preferred embodiment of fuel vapor sensor 130 will be described hereinafter with reference to FIGS. 3 through 5.

Flow adjusting valve 140 operates to control the flow of fuel vapor mixed with air from cartridges 22 and 32 of fuel vapor source 10. When flow adjusting valve 140 is open and there is sufficient vacuum at chamber 146 of the intake manifold, vacuum actuated valve 42 is opened and air is drawn through openings 46 in valve seat 44, openings 52 in movable valve plate 48, cartridge 22 where it may acquire vaporous fuel, cartridge 32 for acquiring vaporous fuel, passage 142, flow adjusting valve 140, and passage 144 to chamber 146 of the engine intake manifold. Flow adjusting valve 140 is a motorized valve designed to enable accurate control of the passage of gasses through itself. Flow adjusting valve 140 is preferably operated by a motor of the type that remains in a position once placed there. One suitable motor is a stepping motor that remains where it is set by virtue of the detent like effect of permanent magnets. Another suitable design is a motor of the type operated by a magnetically powered pawl engaging a ratchet. Either motor design advantageously requires electrical energy only when changing position. Other motor types may be selected by those skilled in the art of motorized valve design. Also, flow adjusting valve 140 must be designed to close tightly to prevent fuel vapor leakage when it is closed.

Air-fuel ratio sensor 160 senses the ratio of air to fuel in the gas exiting chamber 146 of the engine intake manifold through passage 148 at times when flow adjusting valve 140 is open. A preferred embodiment of air-fuel ratio sensor 160 will be described hereinafter with reference to FIGS. 3 through 5.

Mass flow rate sensor 170 senses the mass flow rate of fuel vapor mixed with air from fuel vapor source 10 through flow adjusting valve 140 into the engine intake manifold. Mass flow rate sensor 170 may be the same design as any of the current production mass flow sensors that measure the mass flow rate of air into automobile engines.

Preferred embodiments of fuel vapor sensor 130 and air-fuel ratio sensor 160 will now be described with reference to FIGS. 3 and 4.

Flow diverter 190 provides an obstacle to the flow of engine intake air creating a pressure drop that causes about one percent of the engine intake air to flow through passages 166, chamber 162, and passages 168 back into the engine intake air stream. When flow adjusting valve 140 is open about one percent of the air and fuel vapor mixture flows through passages 166, chamber 162, and passages 168 back into the engine intake air and fuel vapor stream.

Fuel vapor sensor 130 comprises chamber 132 having cylindrical wall 134 and ultrasonic transducer 230 concentric with wall 134 and connected with ultrasonic transducer interface 250. Ultrasonic transducer 230 is preferably a tubular cylindrical piezoelectric transducer adapted to generate and respond to sound propagating perpendicular to its axis of rotational symmetry. Passage 114 connects chamer 132 with the outlet of solenoid valve 110. Passage 136 connects chamber 132 with the intake manifold upstream from chamber 146 where the incoming air from throttle 150 has not mixed with fuel vapor received through flow adjusting valve 140 and passage 144. Passages 138 connect chamber 132 with passages 168 which connect with the intake manifold downstream from flow diverter 190. Ultrasonic transducer 230 is resiliently supported by O-rings 234 and 236 (O-ring 234 is illustrated in FIG. 4, O-ring 236 is not illustrated). O-rings 264 and 266 insulate transducer 230 from acoustic vibrations conducted through the material surrounding chamber 132. For illustration of O-rings 234 and 236 the reader is referred to the illustrations of O-rings 264 and 266 which are the same except for location as O-rings 234 and 236.

Air-fuel ratio sensor 160 comprises chamber 162 having cylindrical wall 164 and ultrasonic transducer 260 concentric with wall 164 and connected with ultrasonic transducer interface 250. Ultrasonic transducer 260 is preferably a tubular cylindrical piezoelectric transducer adapted to generate and respond to sound propagating perpendicular to its axis of rotational symmetry and is preferably the same as ultrasonic transducer 230. Passages 166 connect chamber 162 with the intake manifold upstream from flow diverter 190 and downstream from chamber 146 where the incoming air has mixed with fuel vapor from flow adjusting valve 140. Passages 168 connect chamber 162 with the intake manifold downstream from flow diverter 190. Ultrasonic transducer 260 is resiliently supported by O-rings 264 and 266 which insulate transducer 260 from acoustic vibrations conducted through the material surrounding chamber 162.

Figure 5:
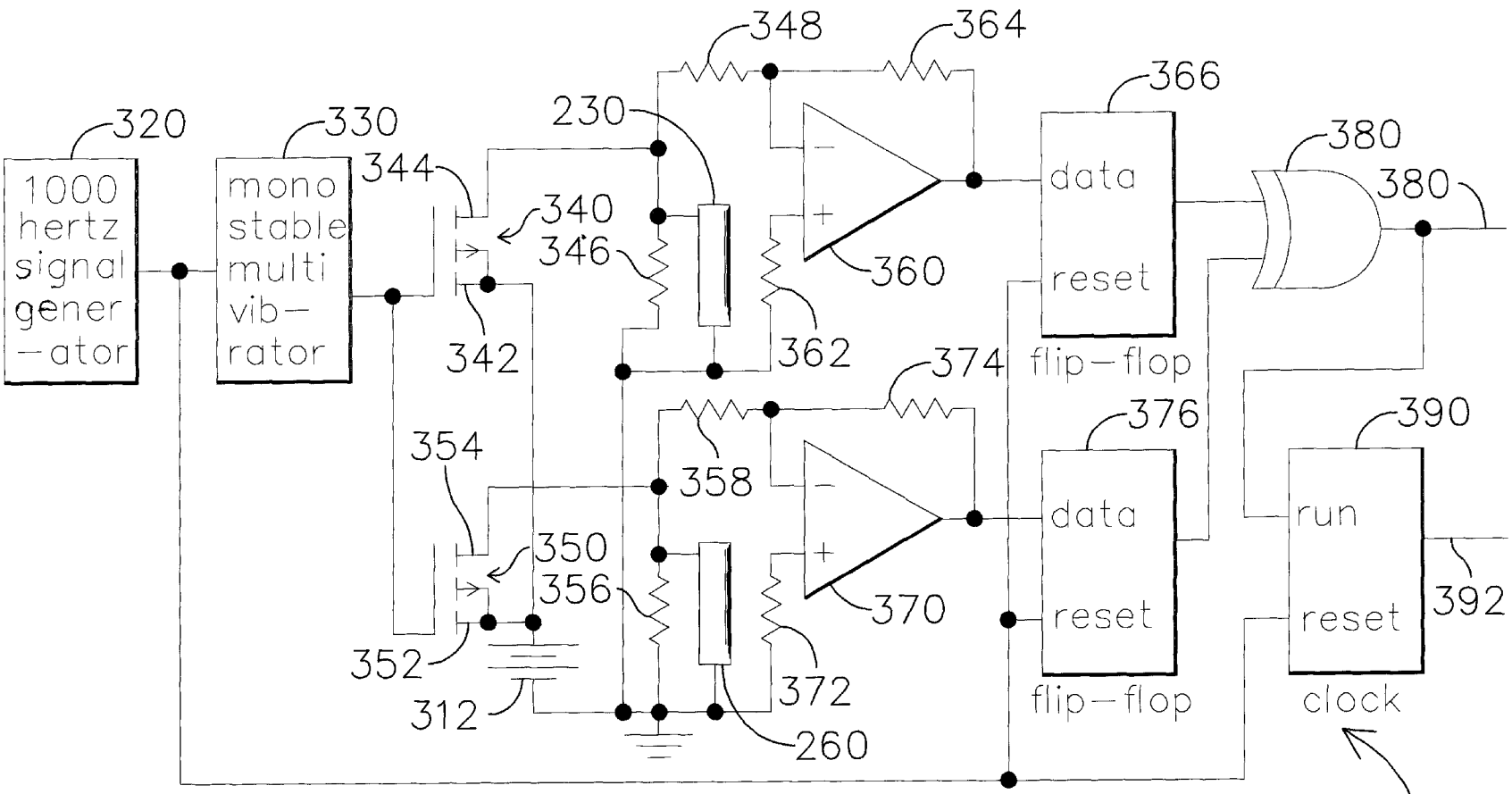
FIG. 5 shows the ultrasonic transducer interface schematically.

Referring now to FIG. 5, the ultrasonic transducer interface 250 in combination with ultrasonic transducers 230 and 260 generate acoustic signals and receive echoes of the acoustic signals to determine the presence of fuel vapor in fuel vapor sensor 130 and the ratio of air to fuel in air-fuel ratio sensor 160.

Continuing with reference to FIG. 5, ultrasonic transducer interface 250 comprises signal generator 320, monostable multivibrator 330, p-channel mosfet power transistors 340 and 350, operational amplifiers 360 and 370, D-type lip flops 366 and 376, exclusive OR 380, and clock or ramp generator 390. It also includes resistors 346, 348, 356, 358, 362, 364, 372 and 374. Piezoelectric transducers 230 and 260 are included schematically in FIG. 5 with their connections illustrated. Battery 312 indicates schematically a source of voltage for momentary application to piezoelectric transducers 230 and 260 to generate acoustic signals.

Signal generator 320 is adapted to generate a square wave output at a frequency such as one thousand square waves per second. The logic high to logic low transition of the output of signal generator 320 causes ultrasonic transducers 230 and 260 to generate acoustic signals. The logic low to logic high transition of the output of signal generator 320 resets D-type flip-flops 366 and 376 and resets clock or ramp generator 390 to zero output in preparation for receipt of signals from transducers 230 and 260. The logic low to logic high transition of the output of signal generator 320 must precede receipt of the first echo signal but preferably does not precede it by any greater time than necessary to minimize the possibility that noise will be mistaken for receipt of the echo.

Monostable multivibrator 330 has a logic high output signal at all times except after transition of the output of signal generator 320 from logic high to logic low when the output of monostable multivibrator 330 goes to logic low and remains there for a brief time such as two microseconds. P-channel mosfet transistors 340 and 350 are electrically conductive when the output of monostable multivibrator 330 is at logic low and are electrically insulating when the output of monostable multivibrator 330 is at logic high. Therefore, when the output of monostable multivibrator 330 is at logic low, P-channel mosfet transistor 340 applies a voltage from voltage source 312 to the outer electrode of piezoelectric transducer 230 for the aforementioned brief time such as two microseconds and P-channel mosfet transistor 350 applies a voltage from voltage source 312 to the outer electrode of piezoelectric transducer 260 for the aforementioned brief time such as two microseconds. Resistors 346 and 356 discharge piezoelectric transducers 230 and 260 respectively after the output of monostable multivibrator 330 returns to logic high and mosfet transistors 340 and 350 no longer apply voltages to the ultrasonic transducers 230 and 260.

Amplifier 360 amplifies the signal received from piezoelectric transducer 230. The output of amplifier 360 is applied to the data input of D-type flip flop 366 to cause it to change from its reset state wherein its output is at logic low to its set state wherein its output is at logic high. D-type flip flop 366 also has a reset input that is connected with the output of signal generator 320. When the signal at its reset input goes from logic low to logic high the output of D-type flip flop 376 is reset to logic low.

Amplifier 370 amplifies the signal received from piezoelectric transducer 260. The output of amplifier 370 is applied to the data input of D-type flip flop 376 to cause it to change from its reset state wherein its output is at logic low to its set state wherein its output is at logic high. D-type flip flop 376 also has a reset input that is connected with the output of signal generator 320. When the signal at its reset input goes from logic low to logic high the output of D-type flip flop 376 is reset to logic low.

Exclusive OR 380 provides a logic high output when one of its inputs is high and a logic low output when its inputs are both high or both low. Clock 390 provides at its output 292 a signal indicating the amount of time since the last reset pulse that the output of exclusive OR 380 has been in its logic high state. This is a measure of the fraction of fuel vapor in the gases in fuel vapor sensor 130 or air-fuel ratio sensor 160.

Clock 390 may be either a digital scaler that counts continuously while its run input is at logic high or a ramp generator that produces a voltage that rises at a constant rate while its run input is at logic high and remains constant while its run input is at logic low. When the signal at its reset input goes from logic low to logic high clock 390 resets its output to zero.

The outputs of exclusive OR 380 and clock 390 are provided to controlling microprocessor 12. When the output of exclusive OR 380 is at logic low and the output of clock 390 is not zero the output of clock 390 indicates the fraction of fuel vapor in either fuel vapor sensor 130 or air-fuel ratio sensor 160.

The operation of the fuel vapor source 10 of the invention will now be described with reference to FIGS. 1 and 2. There are three modes of operation described hereinafter. 1) Charging cartridge 32 of fuel vapor source 10 when it is discharged; 2) Collecting fuel vapors from the vehicle fuel tank and storing them in cartridge 22 during a vehicle heat soak; and 3) supplying fuel vapor from cartridges 22 and 32 to fuel the vehicle engine during initial startup.

First mode of operation—charging cartridge 32.

Initially, fuel vapor source 10 is discharged, that is no fuel vapor is stored in cartridges 22 and 32. This state may occur when the fuel vapor source 10 is new or as a result of purging during the third mode of operation. Before fuel vapor source 10 can supply fuel vapor to an automobile engine at startup, cartridge 32 must be charged.

To charge cartridge 32 of fuel vapor source 10 a vacuum is applied to nipple 133. This vacuum may result from connecting nipple 133 to the engine intake manifold by such as an elastomeric tube (not illustrated). Alternatively or additionally optional electric vacuum pump 135 may provide vacuum. (In FIG. 3 nipple 133 is omitted and passage 136 is shown directly connected with the engine intake manifold.) During charging of cartridge 32 vacuum actuated valve 42 and flow adjusting valve 140 are in their closed states and solenoid valve 110 is in its open state. Flow adjusting valve 140 is closed because it has been closed by controlling microprocessor 12. Vacuum actuated valve 42 is closed because spring 56 is urging movable valve plate 48 toward its closed position with greater force than the vacuum inside outer housing 20 is applying in the opposite direction to movable valve plate 48. The vacuum inside outer housing 20 is not sufficient to open vacuum actuated valve 42 because the passages 112, 114 and 136 are sized to limit the flow therethrough to a rate that can be supplied from the fuel tank through tubing 108 and nipple 106 upon application of a vacuum less than is required to open vacuum actuated valve 42. Solenoid valve 110 is open because it is being energized by controlling microprocessor 12 to be open. The vacuum from electric pump 135 and/or the engine manifold vacuum applied to nipple 133 causes a mixture of air and fuel vapor to be drawn from the vehicle fuel tank (not illustrated) through tube 108 and nipple 106, past screen 38, through cartridge 32 of activated carbon where fuel vapor is adsorbed leaving the air to continue past screen 36, through passage 112, solenoid valve 110, passage 114, fuel vapor sensor 130 and passage 136 to the source of vacuum.

Charging is continued until the activated carbon in cartridge 32 becomes saturated with fuel vapor and allows some of the fuel vapor to exit through passage 112 and through solenoid valve 110 to fuel vapor sensor 130. When this happens fuel vapor sensor 130 indicates to controlling microprocessor 12 that there is fuel vapor inside itself whereupon controlling microprocessor 12 deenergizes solenoid valve 110 which causes it to close. If the vacuum drawing vapor is being created by electric vacuum pump 135 then controlling microprocessor 12 also turns off electric vacuum pump 135. Fuel vapor source 10 is now charged and capable of supplying fuel vapor through passage 142 and flow adjusting valve 140 to the vehicle engine.

Second mode of operation—preventing hydrocarbon release during heat soak.

Initially, the cartridge 22 is discharged, that is no fuel vapor is stored in cartridge 22. This state may occur when the fuel vapor source 10 is new or as a result of purging during the third mode of operation.

When the vehicle is not operating and at certain times of vehicle operation it is possible for pressure in the fuel tank to exceed the pressure in the atmosphere outside the fuel tank and this pressure must be relieved. To prevent release of hydrocarbons into the atmosphere the mixture of air and fuel vapor in the fuel tank is conveyed through tube 108 to nipple 106 of vapor source 10 and passed through cartridge 32 where some lighter fractions of fuel vapor are adsorbed and some heavier fractions are deadsorbed. The resulting mixture of fuel vapor and air is then passed through cartridge 22 where the fuel vapor is adsorbed and the air from which the fuel vapor has been removed exits fuel vapor source 10 through check valve 92. More explicitly, the pressure in the vehicle fuel tank causes fuel vapor and air in the vehicle fuel tank (not illustrated) to flow through tube 108 from the vehicle fuel tank to nipple 106, past screen 38, through cartridge 32, past screens 36 and 28 and through cartridge 22 leaving cleansed air to continue past screen 26 and check valve 92 into the atmosphere. Vacuum actuated valve 42, solenoid valve 110 and flow adjusting valve 140 are in their closed states when the vehicle is not operating. Flow adjusting valve 140 is closed because it was closed by controlling microprocessor 12 before or when the engine was stopped. Vacuum actuated valve 42 is closed because spring 56 is urging movable valve plate 48 toward its closed position. Solenoid valve 110 is closed because it is normally closed and it is not being energized by controlling microprocessor 12.

Third mode of operation—providing fuel vapor at startup.

After cartridge 32 is charged during the first mode of operation as described hereinabove vapor source 10 is capable of fueling an automobile engine when there is sufficient vacuum in the intake manifold to draw fuel vapor from vapor source 10.

At initial starting of the engine there is no vacuum in the intake manifold requiring liquid fuel to be injected under control of controlling microprocessor 12. Simultaneously, controlling microprocessor causes flow adjusting valve 140 to open a predetermined amount in preparation for operation on vapor from fuel vapor source 10. After the engine is started and manifold vacuum develops controlling microprocessor 12 reduces the rate of liquid fuel injection until the engine is operating entirely on vaporous fuel from fuel vapor source 10.

During the third mode of operation (engine fueling) the vacuum in chamber 146 of the engine intake manifold causes air from vacuum actuated valve 42 to pass through cartridges 22 and 32 where it acquires fuel vapor and through passage 142, flow adjusting valve 140 and passage 144 to chamber 146 of the engine intake manifold. Simultaneously, engine throttle 150 is being controlled by the vehicle operator or by controlling microprocessor 12 to admit air to chamber 146 of the engine intake manifold. In chamber 146 fuel vapor from fuel vapor control valve 140 and the air from engine throttle 150 mix and the mixture passes through passage 148 to air-fuel ratio sensor 160.

During the third mode of operation vacuum actuated valve 42 is in its open state, flow adjusting valve 140 is partially open and solenoid valve 110 is in its closed state. Flow adjusting valve 140 is being controlled by controlling microprocessor 12 to be sufficiently open to provide a desired air-fuel ratio at air-fuel ratio sensor 160. Vacuum actuated valve 42 is open because the vacuum inside outer housing 20 is applying greater force to movable valve plate 48 than spring 56 is applying. Solenoid valve 110 is closed because it is not being energized by controlling microprocessor 12 to be open. Air-fuel ratio sensor 160 indicates the air-fuel ratio to controlling microprocessor 12 which may increase or decrease the degree of opening of flow adjusting valve 140 to maintain a desired air-fuel ratio. As operation in the third mode continues the fuel stored in canisters 22 and 32 is depleted. The first species to be deleted is the lightest which is normally a mixture of butanes. As the lightest species are exhausted the canisters 22 and 32 begin supplying heavier components. Depending on its design, air-fuel ratio sensor 160 may or may not accurately indicate the air-fuel ratio when the mixture contains heavier species. In particular, the preferred design of air-fuel ratio sensor 160 described herein with reference to FIGS. 3 through 5 must be recalibrated by comparison with the output of another sensor such as the exhaust oxygen sensor to accurately indicate the airfuel ratio when substantial amounts of heavier species are present.

If air-fuel ratio sensor 160 no longer indicates the ratio of air to fuel because heavier fractions are being issued by fuel vapor source 10 there are optional courses of action. One course of action is for controlling microprocessor 12 to refer to the exhaust oxygen sensor (not illustrated) to ascertain if the engine is receiving the desired air-fuel ratio. Thus, during the first part of startup, when the exhaust oxygen sensor is not warm enough to operate, air-fuel ratio sensor 160 provides controlling microprocessor 12 the information needed to accurately control the air-fuel ratio. After a period of operation when the heavier species begin issuing from fuel vapor source 10 controlling microprocessor 12 obtains the information needed to accurately control the air-fuel ratio from the exhaust oxygen sensor (not illustrated) in combination with information from air-fuel ratio sensor 160. A second course of action is to use mass flow rate sensor 170. Mass flow rate sensor 170 indicates the amount of air and fuel mixture being delivered by fuel vapor source 10. The controlling microprocessor 12 combines this information with its determination of the air inlet mass flow rate to calculate an air-fuel ratio. As the species delivered by fuel vapor source 10 changes the mass flow rate sensor 170 continues to indicate the amount of air and fuel mixture being supplied by vapor source 10. When a divergence occurs between the air-fuel ratio indicated by air-fuel ratio sensor 160 and the air-fuel ratio indicated by mass flow rate sensor 170 the controlling microprocessor 12 relies on the amount of the divergence to indicate the fractions of the different vapor species being delivered and changes its interpretation of the outputs of air-fuel ratio sensor 160 and mass flow rate sensor 170 accordingly to ascertain the amount of fuel vapor being delivered. The use of the exhaust oxygen sensor (not illustrated) is believed to be the preferred design because there is no added cost since oxygen sensors are always present. This preferred design requires that the capacity of cartridge 32 be sufficient to fuel the engine until the exhaust oxygen sensor is warm enough to be operational.

As operation in the third mode continues the rate at which fuel can be obtained from fuel vapor source 10 diminishes until it is not sufficient to meet the needs of the vehicle engine. At this point in the third mode of operation the controlling microprocessor augments the fuel from fuel vapor source 10 by injecting liquid fuel but in smaller quantities than during normal operation. Flow adjusting valve 140 is kept open until air-fuel ratio sensor 160 indicates there is no fuel passing through itself. This indicates that both cartridges 22 and 32 have been purged and are ready for different modes of operation. It may be desirable to continue operating in the third mode for an additional short period of time such as one minute to additionally assure that cartridge 32 is fully purged. Cartridge 22 is now ready to receive fuel vapors during a heat soak. Cartridge 32 is now ready to be recharged. Therefore, at this time, controlling microprocessor 12 closes flow adjusting valve 140 and controls fuel vapor source 10 to operate in its first mode as described hereinabove to recharge cartridge 32.

The operation of the fuel vapor source 10 of the invention will now be described with reference to FIGS. 3 through 5.

As stated hereinabove, there are three modes of operation of fuel vapor source 10: 1) Charging cartridge 32 of fuel vapor source 10 when it is discharged; 2) Storing fuel vapors during overpressure in the fuel tank; and 3) supplying fuel vapor to fuel the engine during initial startup. Operation in the second mode has been fully described hereinabove with reference to FIGS. 1 and 2 and will not be further described hereinafter.

It will become apparent as the description proceeds that at any time only one of the chambers 132 and 162 contains fuel vapor while the other contains air without fuel vapor. Accordingly, when fuel vapor sensor 130 is operating to detect fuel vapor in chamber 132 the signal from air-fuel ratio sensor 160 provides a reference signal related to air without fuel vapor. Similarly, when air-fuel ratio sensor 160 is operating to measure the ratio of air to fuel the signal from fuel vapor sensor 130 provides a reference signal related to air without fuel vapor.

During the first and third modes of operation ultrasonic transducer 230 repeatedly (at a rate of 1000 times per second or other suitable rate) generates sound pulses which radiate in all radial directions toward cylindrical wall 134. Each sound pulse strikes cylindrical wall 134 and is reflected back toward ultrasonic transducer 230 which responds to the reflected sound pulse by producing an electric signal indicative of the intensity of the reflected sound pulse after the sound has passed radially outward and the reflected sound has passed radially inward through chamber 132. Similarly, ultrasonic transducer 260 repeatedly generates sound pulses which radiate in all radial directions toward cylindrical wall 164. Each sound pulse strikes cylindrical wall 164 and is reflected back toward ultrasonic transducer 260 which responds to the reflected sound pulse by producing an electric signal indicative of the intensity of the reflected sound pulse after the sound has passed radially outward and the reflected sound has passed radially inward through chamber 162.

First mode of operation—charging cartridge 32.

To initiate the first mode of operation controlling microprocessor 12 (illustrated in FIGS. 1 and 2) energizes normally closed solenoid valve 110 to open. This allows manifold vacuum to draw a mixture of air and fuel vapor from the vehicle fuel tank into fuel vapor source 10 as described hereinabove with reference to FIGS. 1 and 2 and through passage 112, normally closed solenoid valve 110 and passage 114 into chamber 132 of fuel vapor sensor 130.

Figures 3, 4:
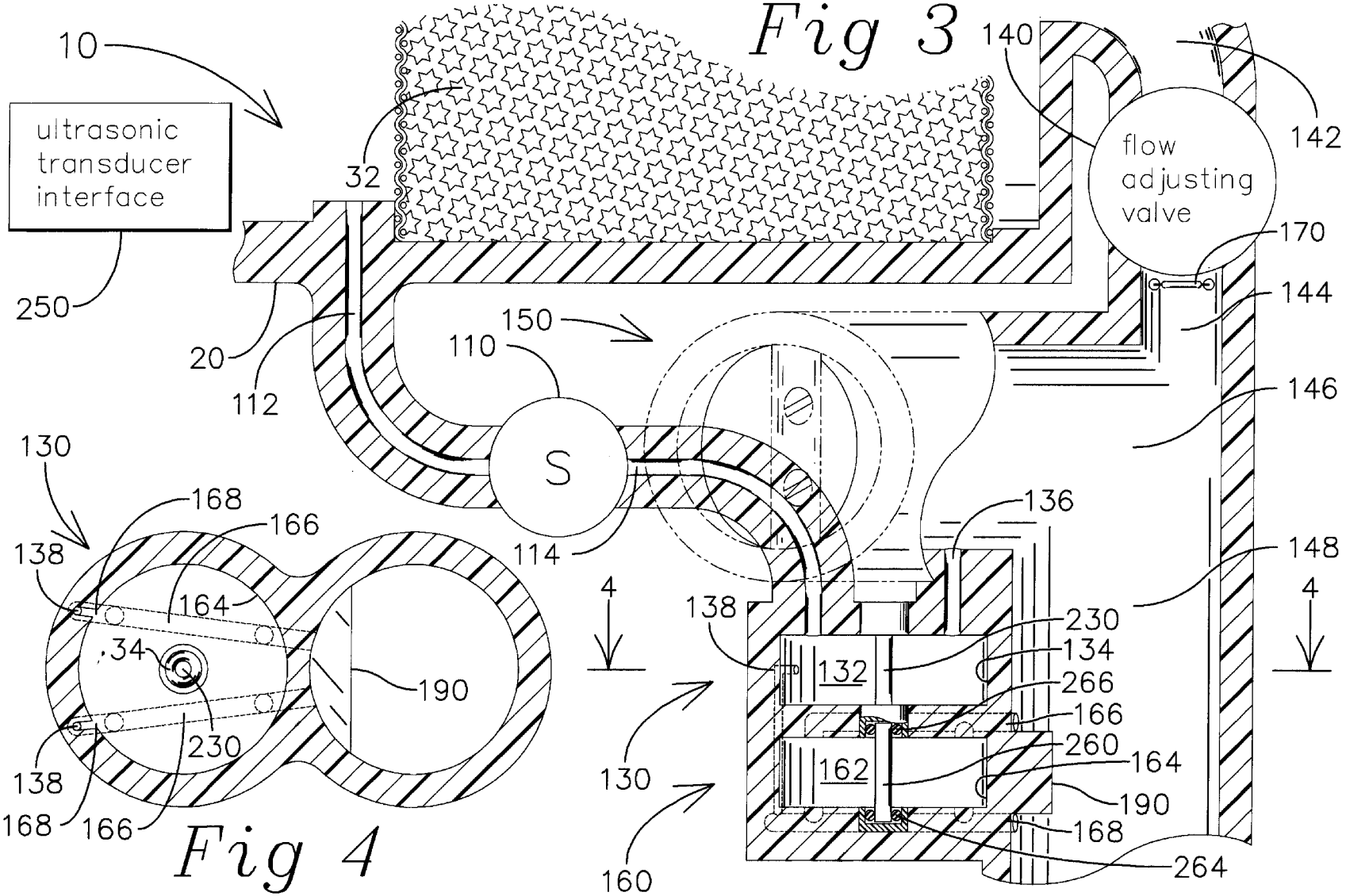
FIG. 3 shows a view of the fuel vapor sensor and the air-fuel ratio sensor of the invention with certain parts shown in section.
FIG. 4 shows a view of the fuel vapor sensor and the air-fuel ratio sensor of the invention taken at section 4—4 of FIG. 3.

Continuing with reference to FIGS. 3 through 5, during the first mode of operation cartridge 32 is charged with fuel from a mixture of air and fuel vapor drawn from the vehicle fuel tank. Therefore, initially, chamber 132 is receiving air without fuel vapor through passage 114 because the fuel vapor is being retained by cartridge 32. Simultaneously, chamber 162 is receiving air without fuel vapor through passage 166. Each time the signal from signal generator 320 changes from logic high to logic low ultrasonic transducers 230 and 260 each generate a sound wave. The sound wave generated by ultrasonic transducer 230 radiates outward until it reaches cylindrical wall 134 whereupon it is reflected toward ultrasonic transducer 230 to which it returns. Similarly, the sound wave generated by ultrasonic transducer 260 radiates outward until it reaches cylindrical wall 164 whereupon it is reflected toward ultrasonic transducer 260 to which it returns. While both chambers 132 and 162 contain air without fuel vapor the speed of sound is approximately the same in both chambers and ultrasonic transducer 230 receives the echo of the sound it generated at about the same time as ultrasonic transducer 260 receives the echo of the sound it generated. The speed of sound may not be precisely the same in both chambers 132 and 162 because the air entering chamber 132 may not have exactly the same temperature and humidity as the air entering chamber 162. Consequently, D-type flip-flop 366 is set at about the same time as D-type flip-flop 376 and the output of exclusive OR 380 is almost always in its low state. Therefore the time period during which clock 390 can advance is zero or very small and the output of clock 390 remains at or very close to zero thereby indicating to controlling microprocessor 12 (illustrated in FIGS. 1 and 2) that there is no fuel mixed with the air in fuel vapor sensor 130.

As operation in the first mode continues cartridge 32 accumulates more and more fuel. When its capacity is reached the lightest elements of fuel exit through passage 112, solenoid valve 110, and passage 114 into chamber 132 of fuel vapor sensor 130. The fuel vapor mixed with the air in chamber 132 causes the speed of sound to be less than the speed of sound in air not mixed with fuel. Chamber 162 continues to be filled with air not combined with significant amounts of fuel vapor because most of the air passing flow diverter 190 enters from throttle 150. Consequently, ultrasonic transducer 230 receives the echo of the sound it generated later than ultrasonic transducer 260 receives the echo of the sound it generated. Between the time ultrasonic transducer 260 receives the echo of the sound it generated and the time ultrasonic transducer 230 receives the echo of the sound it generated the output of exclusive OR 380 is in its high state which enables clock 390 to increase its output. The increased output is communicated by way of connection 392 to controlling microprocessor 12 (illustrated in FIGS. 1 and 2). When the output of clock 390 reaches a predetermined level, which indicates cartridge 32 is fully charged with fuel, controlling microprocessor 12 deenergizes normally closed solenoid valve 110 which allows it to return to its normally closed state. This terminates operation in the first mode and leaves cartridge 32 fully charged with high volatility fuel adsorbed on the activated carbon. It will now be appreciated that in the first mode of operation while fuel vapor sensor 130 is operating to detect fuel vapor in chamber 132 the air-fuel ratio sensor 160 is operating to provide a reference signal related to the speed of sound in air not mixed with fuel vapor.

Operation in the third mode will now be described with reference to FIGS. 3 through 5.

Third mode of operation—supplying fuel vapor to the vehicle engine

The third mode of operation requires sufficient vacuum at chamber 146 to draw an adequate flow of fuel vapor from cartridge 32. Accordingly, it is expected that upon initial startup the engine will be supplied injected fuel until it reaches an operating speed such as 500 revolutions per minute and there is sufficient manifold vacuum for operation on vapor adsorbed in cartridge 32. However, flow adjusting valve 140 is preferably open at initial engine starting to allow fuel vapor from cartridge 32 to begin contributing fuel to the engine as soon as manifold vacuum develops. To initiate the third mode of operation controlling microprocessor 12 (illustrated in FIGS. 1 and 2) controls flow adjusting valve 140 to open a predetermined amount known from experience to he approximately the opening that provides a desired air-fuel ratio. This allows manifold vacuum to draw a mixture of air and fuel vapor from cartridge 32 as described hereinabove with reference to FIGS. 1 and 2, through passage 142, flow adjusting valve 140 and passage 144 into chamber 146 of the engine intake manifold where it mixes with intake air from the throttle 150.

Continuing with reference to FIGS. 3 through 5, during the third mode of operation fuel vapors stored in cartridge 32 are withdrawn and mixed with air to obtain an air-fuel ratio approximating the stoichiometric ratio which is believed to be optimum for initial operation. Initially, cartridge 32 releases the lightest species stored which is primarily a mixture of n-butane and iso-butane. The butane is mixed with engine intake air from throttle 150 at chamber 146 of the engine intake manifold to obtain a stoichiometric air-fuel mixture which is routed by the engine intake manifold to the cylinders where it is burned.

During operation in the third mode the small pressure differential created by flow diverter 190 causes a small flow of air without fuel vapor to enter chamber 132 through passage 136 and leave through passages 138 and 168. Simultaneously, the small pressure differential created by flow diverter 190 causes about one percent of the air-fuel mixture from chamber 146 to enter chamber 162 through passages 166 and leave through passages 168. Each time the signal from signal generator 320 changes from logic high to logic low ultrasonic transducers 230 and 260 each generate a sound wave. The sound wave generated by ultrasonic transducer 230 radiates outward until it reaches cylindrical wall 134 whereupon it is reflected toward ultrasonic transducer 230 to which it returns. Similarly, the sound wave generated by ultrasonic transducer 260 radiates outward until it reaches cylindrical wall 164 whereupon it is reflected toward ultrasonic transducer 260 to which it returns.

Because chamber 132 contains air without fuel vapor and chamber 162 contains a mixture of air and fuel in approximately a stoichiometric ratio the speed of sound in chamber 162 is less than the speed of sound in chamber 132 and ultrasonic transducer 260 receives the echo of the sound it generated after ultrasonic transducer 230 receives the echo of the sound it generated. The difference in arrival time of the echoes is proportional to the fraction of fuel in chamber 162. Consequently, during each cycle of signal generator 320, the output of exclusive OR 380 is in its high state for an amount of time proportional to the fraction of fuel in chamber 162. While the output of exclusive OR 380 is in its high state the output of clock 390 advances so that the output of clock 390 is proportional to the fraction of fuel in chamber 162 thereby indicating the reciprocal of the air-fuel ratio to controlling microprocessor 12 (illustrated in FIGS. 1 and 2).

If the air-fuel ratio is within predetermined limits controlling microprocessor 12 takes no action and waits for the results of the next cycle of signal generator 320. If the air-fuel ratio is greater than the desired range then controlling microprocessor 12 controls the movable element of flow adjusting valve 140 to move to a slightly more open position. If flow adjusting valve 140 is operated by a stepping motor this consists of commanding the stepping motor to take one step in the direction that opens flow adjusting valve 140. If the air-fuel ratio is less than the desired range then controlling microprocessor 12 controls the movable element of flow adjusting valve 140 to move to a slightly more closed position. If flow adjusting valve 140 is operated by a stepping motor this consists of commanding the stepping motor to take one step in the direction that closes flow adjusting valve 140.

As fuel vapor source 10 continues to supply fuel to the engine the supply of the most volatile species (mostly butanes) is exhausted and the next most volatile species (mostly pentanes) begins issuing. When this happens the relationship between the air-fuel ratio and the signal output from clock 390 changes. Further, it changes gradually so that it is not possible to immediately switch to a different proportionality factor. Therefore, cartridge 32 must be large enough that the exhaust oxygen sensor (not illustrated) has sufficient time to warm up and begin operating before cartridge 32 begins releasing less volatile species. With the exhaust oxygen sensor operating the controlling microprocessor (illustrated in FIGS. 1 and 2) adjusts flow adjusting valve 140 in accordance with both air-fuel ratio sensor 160 and the exhaust oxygen sensor. The air-fuel ratio sensor 160 provides an immediate response upon which adjustment of flow adjusting valve 140 is based and the exhaust oxygen sensor provides a slightly delayed indication of the air-fuel ratio which is used for adjusting and calibrating the output of air-fuel ratio sensor 160. It will now be appreciated that in the third mode of operation while the air-fuel ratio sensor 160 is operating to measure the ratio of air to fuel in chamber 162 the fuel vapor sensor 130 is operating to provide a reference signal related to the speed of sound in air not mixed with fuel vapor.

It is important to completely purge fuel vapor source 10 whenever it is used to supply fuel vapor because a partially discharged carbon canister retains high proportions of heavier species which, if not removed by purging, would reduce the capacity of the canister to store the lighter species. Therefore operation in the third mode continues under control of the controlling microprocessor (illustrated in FIGS. 1 and 2) until the output of clock 390 approaches to within a predetermined difference from zero indicating the air passing through chamber 162 is not mixed with fuel vapor. Further, it may be desirable to continue purging cartridge 32 for a predetermined time after no vapor is being indicated by air-fuel ratio sensor 160 to further assure complete purging of cartridge 32. As cartridge 32 becomes depleted the output of fuel vapor diminishes so that even with flow adjusting valve 140 completely open injection of liquid fuel is required. The rate of liquid fuel injection is increased as required until cartridge 32 is purged when normal operation is resumed. Also, operation on liquid fuel is required when the throttle is at or near its wide open position because then there is insufficient vacuum to draw fuel vapor from fuel vapor source 10.

Although the description of this invention has been given with reference to a particular embodiment, it is not to be construed in a limiting sense. Many variations and modifications will now occur to those skilled in the relevant arts. For a definition of the invention reference is made to the appended claims.

What is claimed is:

1. A fuel vapor source (10) for supplying fuel vapor to a vehicle engine comprising a container containing a first aggregation of fuel vapor adsorbing material (32) and also comprising:

conduit means (108) connecting said fuel vapor source with a fuel tank of a vehicle, fuel storing means comprising vacuum means (133, 135) adapted to draw air and fuel vapor from said fuel tank through said conduit means to said first aggregation, fuel vapor supplying means comprising said first aggregation and combining means (142, 144, 146, 148, 150) for combining stored fuel vapor from said first aggregation and combustion air and supplying said combination to said engine, first sensing means (160) adapted to indicate the fraction of fuel in said combined fuel vapor and combustion air, and first valve means (12, 140) responsive to said first sensing means by controlling said fraction of fuel.

2. The invention as defined by claim 1 wherein said container also contains a second aggregation of fuel vapor adsorbing material (22) and a check valve (92) whereby, said fuel vapor source also operates to adsorb fuel vapor vented to relieve pressure in said vehicle fuel tank.

3. The invention as defined by claim 1 including:

second sensing means (130) adapted to indicate when said first aggregation of fuel vapor adsorbing material is charged with fuel vapor, and second valve means (12, 110) responsive to said second sensing means by terminating said drawing of air and fuel vapor from said fuel tank by said vacuum means.

4. The invention as defined by claim 3 wherein said second sensing means comprises a first chamber (132) and including:

conduit means (112, 114) adapted to provide said air and fuel vapor drawn by said vacuum means that has passed through said first aggregation to said first chamber during said drawing of air and fuel vapor, first timing means (134, 230, 250) adapted to cause sound to traverse a first predetermined route in said first chamber, and wherein:

said second sensing means is responsive to the time required for said sound to traverse said first predetermined route.

5. The invention as defined by claim 4 wherein:

said first predetermined route comprises an outward route and a return route that is the reverse of the outward route.

6. The invention as defined by claim 5 wherein:

said outward route is a radial outward traversal from a cylindrical starting position and said return route is a radial inward traversal returning to said starting position.

7. The invention as defined by claim 4 wherein said second sensing means comprises a second chamber (162) and including:

conduit means (166, 168) adapted to provide air to said second chamber during said drawing of air and fuel vapor, second timing means (164, 260, 250) adapted to cause sound to traverse a second predetermined route in said second chamber, and wherein:

said second sensing means is responsive to the difference between said time required for sound to traverse said first predetermined route and the time required for sound to traverse said second predetermined route.

8. The invention as defined by claim 1 wherein said first sensing means comprises a third chamber (162) and including:

conduit means (166, 168) adapted to provide said combined fuel vapor and combustion air to said third chamber during said combining of stored fuel vapor and combustion air, third timing means (164, 260, 250) adapted to cause sound to traverse a third predetermined route in said third chamber, and wherein:

said first sensing means is responsive to the time required for sound to traverse said third predetermined route.

9. The invention as defined by claim 8 wherein:

said third predetermined route comprises an outward route and a return route that is the reverse of the outward route.

10. The invention as defined by claim 9 wherein:

said outward route is a radial outward traversal from a cylindrical starting position and said return route is a radial inward traversal returning to said starting position.

11. The invention as defined by claim 8 wherein said first sensing means comprises a fourth chamber (132) and including:

conduit means (136, 138, 168) adapted to provide air to said fourth chamber during said combining of stored fuel vapor and combustion air, fourth timing means (134, 230, 250) adapted to cause sound to traverse a fourth predetermined route in said fourth chamber, and wherein:

said first sensing means is responsive to the difference between said time required for sound to traverse said third predetermined route and the time required for sound to traverse said fourth predetermined route.

12. The invention as defined by claim 1 wherein:

said fuel storing means comprises a connection (133) to the intake manifold vacuum of said engine.

13. The invention as defined by claim 1 wherein:

said fuel storing means comprises a vacuum pump (135).

14. The invention as defined by claim 2 wherein:

said check valve is adapted to release pressurized gas from said fuel vapor source.

15. The invention as defined by claim 1 wherein said first sensing means comprises a third chamber (162) and including:

second sensing means (130) comprising a first chamber (132) adapted to indicate when said first aggregation of fuel vapor adsorbing material is charged with fuel vapor, second valve means (12, 110) responsive to said second sensing means by terminating said drawing of air and fuel vapor from said fuel tank by said vacuum means.

conduit means (112, 114) adapted to provide said air and fuel vapor drawn by said vacuum means that has passed through said first aggregation to said first chamber during said drawing of air and fuel vapor, first timing means (134, 230, 250) adapted to cause sound to traverse a first predetermined route in said first chamber, conduit means (166, 168) adapted to provide said combined fuel vapor and combustion air to said third chamber during said combining of stored fuel vapor and combustion air, third timing means (164, 260, 250) adapted to cause sound to traverse a third predetermined route in said third chamber, and wherein:

said first sensing means is responsive to the time required for sound to traverse said third predetermined route, and said second sensing means is responsive to the time required for sound to traverse said first predetermined route.

16. The invention as defined by claim 15 wherein said first sensing means comprises a fourth chamber (132) and including:

conduit means (136, 138, 168) adapted to provide air to said fourth chamber during said combining of stored fuel vapor and combustion air, fourth timing means (134, 230, 250) adapted to cause sound to traverse a fourth predetermined route in said fourth chamber, and wherein:

said fourth chamber is the same chamber as said first chamber, and said first sensing means is responsive to the difference between said time required for sound to traverse said third predetermined route and the time required for sound to traverse said fourth predetermined route.

17. The invention as defined by claim 15 wherein said second sensing means comprises a second chamber (162) and including:

conduit means (166, 168) adapted to provide air to said second chamber during said drawing of air and fuel vapor, second timing means (164, 260, 250) adapted to cause sound to traverse a second predetermined route in said second chamber, and wherein:

said second chamber is the same chamber as said third chamber, and said second sensing means is responsive to the difference between said time required for sound to traverse said first predetermined route and the time required for sound to traverse said second predetermined route.

18. A fuel vapor source (10) for supplying fuel vapor to a vehicle engine comprising a container containing a first aggregation of fuel vapor absorbing material (32) having absorbed fuel vapor and also comprising:

fuel vapor supplying means comprising combining means (142,144,146,148,150) for combining fuel-bearing vapor from said container and combustion air and supplying said combination to said engine, sensing means (160 or 170,12) for measuring the fraction of fuel in said fuel-bearing vapor and combustion air combination, and valve means (12,140) responsive to said sensing means by controlling said fraction of fuel.

19. The invention as defined by claim 18 wherein:

said adsorbed fuel vapor is supplied through ducts (142, 144), and including:

an engine controlling microprocessor (12) to which a mass flow rate of said combustion air is known, and a mass flow rate sensor (170) responsive to flow through said ducts by indicating a mass flow rate to said engine controlling microprocessor, and wherein:

said sensing means comprises calculation means in said engine controlling microprocessor for combining said mass flow rate of said combustion air and said mass flow rate indicated by said mass flow rate sensor.

20. The invention as defined by claim 18 including, a controlling microprocessor (12) adapted for controlling injection of fuel into said engine, and wherein:

said controlling microprocessor augments said fuel vapor supplied to said engine by injecting liquid fuel while said fuel vapor is being supplied but in quantities inadequate to meet the needs of said engine.

21. A sensor responsive to the fraction of fuel vapor in a mixture of air and fuel vapor comprising:

a first sound generating means (260) adapted for generating a first sound in said mixture of air and fuel vapor, a first sound receiving means (260) responsive to receipt of said first sound, said first sound requiring a first time duration to travel between said first sound generating means and said first sound receiving means, a second sound generating means (230), adapted for generating a second sound in air not mixed with fuel vapor, a second sound receiving means (230) responsive to receipt of said second sound, said second sound requiring a second time duration to travel between said second sound generating means and said second sound receiving means, and signal processing means (250) responsive to said first sound receiving means and said second sound receiving means by indicating the difference between said first time duration and said second time duration.

22. The invention as defined by claim 21 wherein:

said first sound generating means is a piezoelectric transducer.

23. The invention as defined by claim 22 wherein:

said first sound receiving means is the same piezoelectric transducer as said first sound generating means.

24. The invention as defined by claim 23 wherein:

said first sound generating and receiving means is a cylindrical piezoelectric transducer adapted to generate sound waves travelling radially outward from its cylindrical outer surface and including:

a first sound reflector (164) comprising a cylindrical surface positioned concentrically with said first sound generating and receiving means, whereby said sound generated by said first sound generating and receiving means travels radially outward to said first sound reflector and its reflection travels radially inward to said first sound generating and receiving means for receipt thereby.

* * * * *